US008130150B2

(12) United States Patent
Wang et al.

(10) Patent No.: US 8,130,150 B2
(45) **Date of Patent: *Mar. 6, 2012**

(54) HYBRID ANTENNA FOR USE WITH WWAN WLAN AND WMAN

(75) Inventors: Shu-Yean Wang, Tu-cheng (TW); Chen-Ta Hung, Tu-cheng (TW); Yun-Lung Ke, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 333 days.

This patent is subject to a terminal disclaimer.

(21) Appl. No.: 12/386,116

(22) Filed: Apr. 14, 2009

(65) Prior Publication Data

US 2009/0256779 A1 Oct. 15, 2009

(30) Foreign Application Priority Data

Apr. 14, 2008 (TW) ..... 97113435 A

(51) Int. Cl.
*H01Q 5/00* (2006.01)

(52) U.S. Cl. ..... 343/700 MS; 343/893; 343/702; 343/846; 343/829

(58) Field of Classification Search ..... 343/700 MS, 343/702, 829, 846, 893
See application file for complete search history.

(56) References Cited

U.S. PATENT DOCUMENTS 7,289,071 B2 10/2007 Hung et al.
7,466,272 B1 * 12/2008 Su et al. ..... 343/700 MS
7,932,861 B2 * 4/2011 Hung et al. ..... 343/700 MS
2004/0233109 A1 11/2004 Ying
2006/0262016 A1 * 11/2006 Hung et al. ..... 343/702
2007/0257847 A1 * 11/2007 Su et al. ..... 343/700 MS
2007/0285321 A1 * 12/2007 Chung et al. ..... 343/702
2009/0146884 A1 * 6/2009 Lee et al. ..... 343/700 MS

* cited by examiner

*Primary Examiner* — Jacob Y Choi
*Assistant Examiner* — Shawn Buchanan
(74) *Attorney, Agent, or Firm* — Wei Te Chung; Andrew C. Cheng; Ming Chieh Chang

(57) ABSTRACT

A multi-band antenna includes a grounding element, a first antenna connected to the grounding element, a second antenna connected to the grounding element and a coupling radiating arm extending from the grounding element. The grounding element extends along a lengthwise direction and includes first and second lengthwise sides. The first antenna includes a first connecting element extending from the grounding element and a first radiating element electrically connected to the first connecting element. The second antenna includes a second connecting element extending from the grounding element and a second radiating element electrically connected to the second connecting element. The first radiating element includes a first radiating portion extending from the first connecting element in both a longitudinal direction and a transverse direction and a second radiating portion substantially being leptosomatic. The second radiating element substantially extends in a lengthwise direction and forms a first radiating section operating on a first frequency band and a second radiating section operating on a second frequency band. The first antenna is located between the first antenna and the second antenna in a vertical direction. The coupling radiating arm is between the first radiating section of the second radiating element of the second antenna and the grounding element in a vertical direction.

20 Claims, 4 Drawing Sheets

HYBRID ANTENNA FOR USE WITH WWAN WLAN AND WMAN

BACKGROUND OF THE INVENTION

1. Field of the Invention

The present invention relates generally to a combination antenna, and more particularly to a combination antenna covering multiple frequency bands used for WWAN, WLAN and WMAN.

2. Description of the Prior Art

In recent years, wireless handsets, such as netbook, PDA et al., and notebooks are always integrally incorporated with different antennas so as to work in different networks, such as Wireless Wide Area Network (WWAN), Wireless Local Area Network (WLAN) and Wireless Metropolitan Area Network (WMAN). However, the market trend is to design a smaller and slimmer electrical device. The antenna is incorporated within those electrical devices has to be reduced into compact size so as to meet the requirements. For this reason, multiple antennas respectively arranged in the electrical devices can not meet the requirements on volume. U.S. Pat. No. 7,289,071 issued to Chen-Ta Hung et al. on Oct. 30, 2007, discloses a combinational antenna used for WWAN and WLAN, but this antenna can not be used for WMAN due to its narrowed bandwidth.

Hence, in this art, a combinational antenna used for multiple networks so as to overcome the above-mentioned disadvantages of the prior art should be provided.

BRIEF SUMMARY OF THE INVENTION

A primary object, therefore, of the present invention is to provide a multi-band antenna with compact structure.

In order to implement the above object, the multi-band antenna comprises a grounding element, a first antenna connected to the grounding element, a second antenna connected to the grounding element and a coupling radiating arm extending from the grounding element. The grounding element extends along a lengthwise direction and comprises first and second lengthwise sides. The first antenna comprises a first connecting element extending from the grounding element and a first radiating element electrically connected to the first connecting element. The second antenna comprises a second connecting element extending from the grounding element and a second radiating element electrically connected to the second connecting element. The first radiating element comprises a first radiating portion extending from the first connecting element in both a longitudinal direction and a transversal direction and a second radiating portion substantially being leptosomatic. The second radiating element substantially extends in a lengthwise direction and forms a first radiating section operating on a first frequency band and a second radiating section operating on a second frequency band. The first antenna is located between the first antenna and the second antenna in a vertical direction. The coupling radiating arm is located between the first radiating section of the second radiating element of the second antenna and the grounding element in a vertical direction.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment made in accordance with the present invention.

Figure 1:
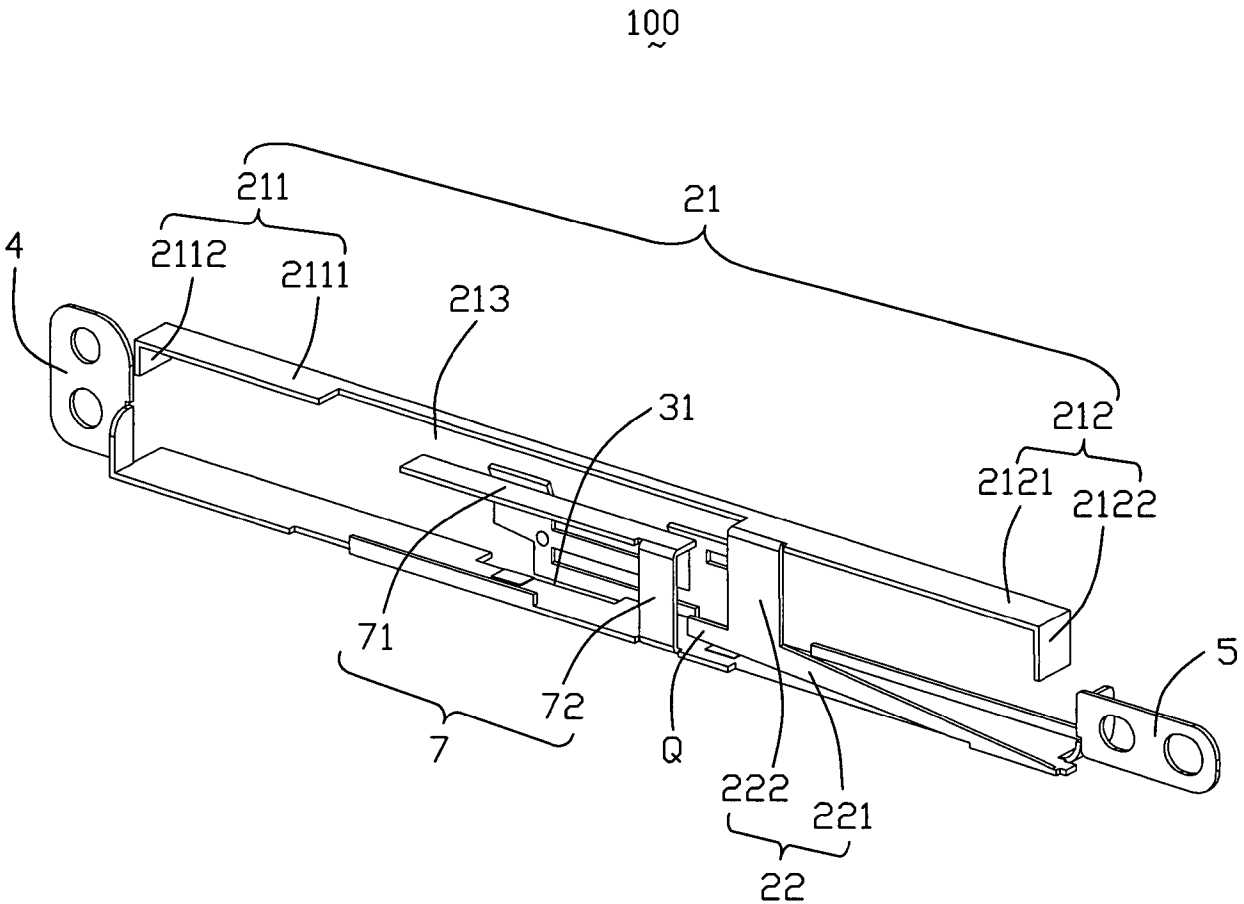
FIG. 1 is a perspective view illustrating a preferred embodiment of a multi-band antenna made in accordance with the present invention.
Figure 2:
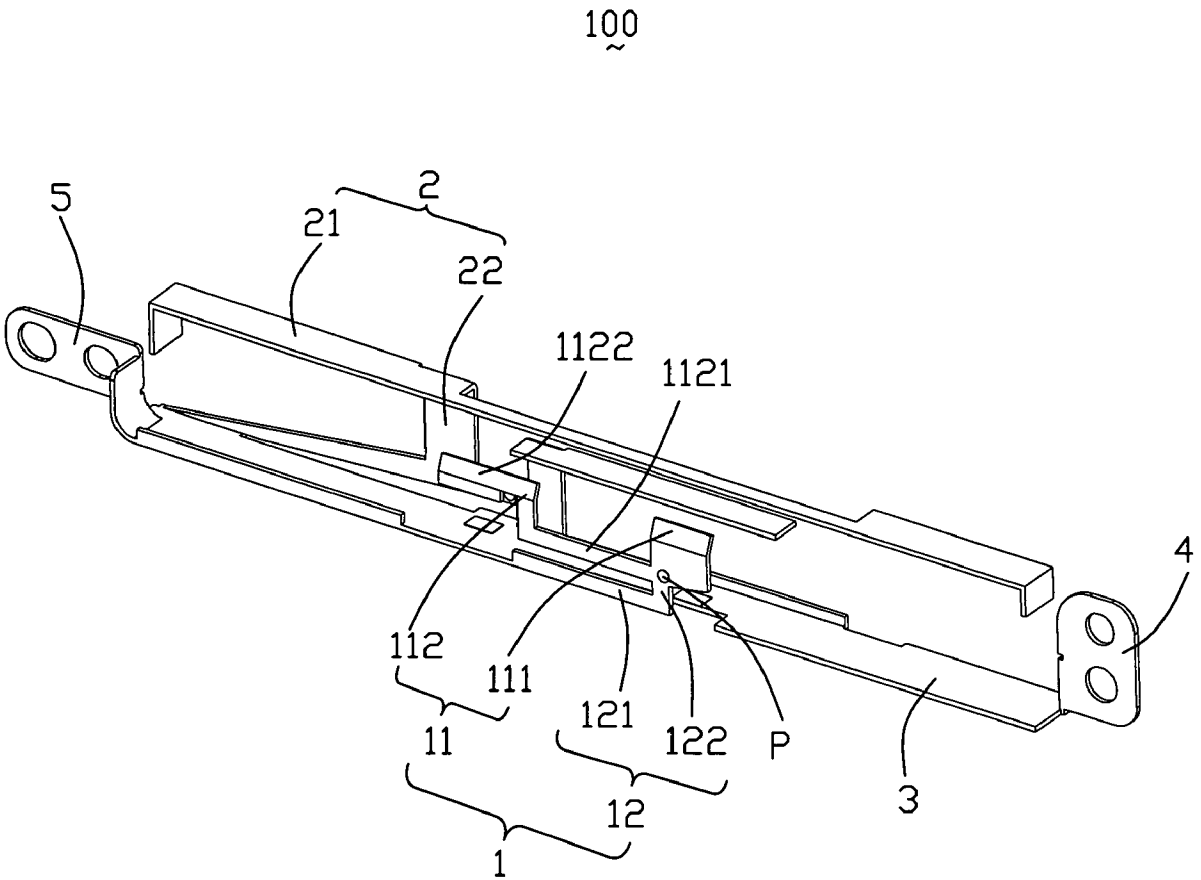
FIG. 2 is a perspective view of the antenna shown in FIG. 1, but viewed from another angle.

Reference to FIGS. 1 and 2, a multi-band antenna 100 made in accordance with a preferred embodiment of the present invention is shown. The multi-band antenna 100 is intended for being incorporated within an electric device such as a notebook so as to get access of network service within the WWAN, WLAN and WMAN. The multi-band antenna 100 is made by a metallic sheet and comprises a grounding element 3 substantially extending along a lengthwise direction and having a pair of setting portions 4, 5 extending from the first and second ends 301, 302 thereof, a first antenna 1 extending from a first side 304 of the grounding element 3 and a second antenna 2 extending from a second side 305 of the grounding element 3.

The first antenna 1 is operable within the WLAN and WMAN and extends upward from the first side 304 of the grounding element 3. The first antenna 1 is located between the second antenna 2 and the grounding element 3 in a vertical direction and comprises a first radiating element 11 spaced apart from the grounding element 3 along the vertical direction, and a first connecting element 12 connecting the first radiating element 11 to the grounding element 3. The first connecting element 12 substantially has a substantially L-shaped configuration and comprises a first connecting arm 121 connected to the grounding element 3 and a second connecting arm 122 connected to the first radiating element on a point P. The first connecting arm 121 extends from the first side 304 of the grounding element 3 along a horizontal direction to form a slot between the first connecting arm 121 and the grounding element 3 because of the grounding element 3 having a first cutout 31. The first radiating element 11 comprises a first radiating portion 111 extending from the point P in a first direction and works at 5.15 GHz-5.85 GHz frequencies, and a second radiating portion 112 extending from the point P in a second direction different from the first direction and operating at 2.4 GHz-2.7 GHz frequencies. The first radiating portion 111 has a substantially rectangular shape and the second radiating portion 112 has a substantially Z-shaped configuration which is longer than the first radiating portion 111. In the other embodiments, the shape of the first and second radiating portions 111, 112 can be changed to fit in an antenna compartment of the electrical device. The first antenna 1 further comprises a first feeding line (not shown) having a first inner conductor (not shown) connected to the point P and a first outer conductor (not shown) connected to the grounding element 3. In other embodiment, the first inner conductor of the first feeding line could be connected to the first radiating element 11 on another point spaced apart form the point P.

The second antenna 2 extends substantially along the lengthwise direction and is operable within the WWAN. The second antenna 2 comprises a second radiating element 21 spaced apart from the grounding element 3 in the vertical direction and a second connecting element 22 connecting the second radiating 21 to the grounding element 3. The second connecting element 22 comprises a first connecting portion 221 extending from the second end and the second side 305 of the grounding element 3 along a gradient direction and forming a slot between the first connecting portion 221 and the grounding element 3, and a second connecting portion 222 extending upwardly from the first connecting portion 221 and having an end connected to the second radiating element 222. The first connecting portion 221 is a trapeziform shape which has a horizontal edge and can be looked as being formed by a trapezium and a triangle, and the second connecting portion 222 extends from the horizontal edge of the first connecting portion 221. The grounding element 3 has a second cutout 32 under the first connecting portion 221 to make the slot between the grounding element 3 and the first connecting portion 211 wider. The second radiating element 21 has a main portion perpendicular to the grounding element 3 except those two ends thereof extend respectively and downwardly from the main portion. The second radiating element 21 includes a first radiating section 211 extending from the second connecting portion 222 in the first direction and operating at a lower frequency, such as 900 MHz, and a second radiating section 212 extending from the second connecting portion in the second direction and operating at a higher frequency, such as 1800 MHz. The first radiating section 211 includes a first radiating arm 2111 perpendicular to the grounding element 3 and a second radiating arm 2112 extending downwardly from the end of the first radiating arm 2111. The second radiating section 212 includes a third radiating arm 2121 perpendicular to the grounding element 3 and a fourth radiating arm 2122 extending downwardly from the end of the third radiating arm 2121.

A coupling radiating arm 7 upward extends from the second side 305 of the grounding element 3 and between the first radiating section 211 of the second radiating element 21 of the second antenna 2 in the vertical direction. The coupling radiating arm 7 has an L-shaped configuration and includes a first side arm 71 extending from the two side of the grounding element 3 on the location adjacent to the second cutout 32 of the grounding element 3, and a second side arm 72 extending from the end of the first side arm 71 in the first direction. A gap 213 is formed above the coupling radiating arm 71 on the first radiating section 211 of the second radiating element 21. The coupling radiating arm 7 integrates the second radiating section 211 of the second radiating element 21 so as to form wide frequency band.

Figure 3:
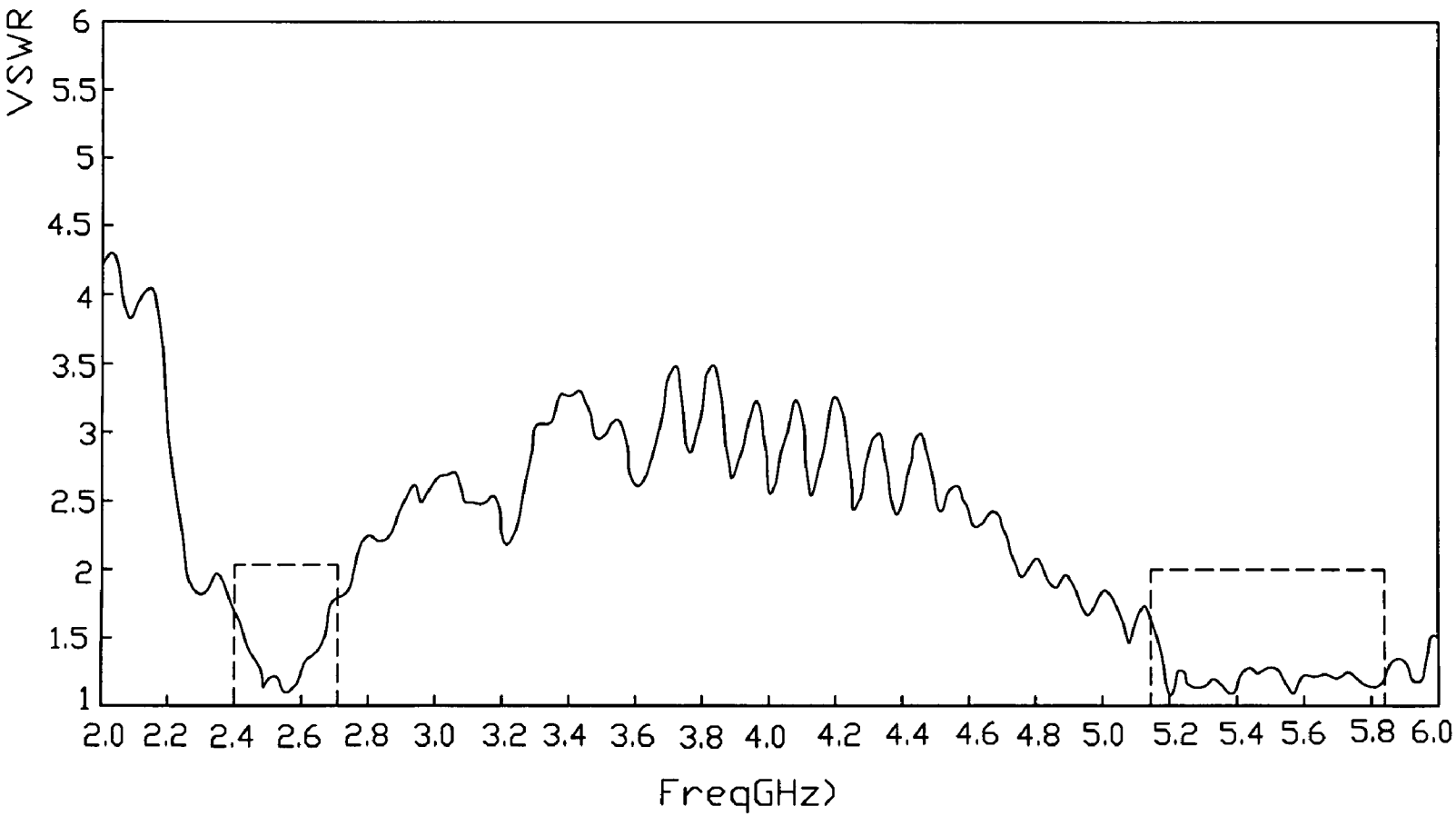
FIG. 3 is a test chart record of the first antenna of the multi-band antenna made in accordance with present invention, showing Voltage Standing Wave Ratio (VSWR) as a function of WLAN and WMAN frequencies.
Figure 4:
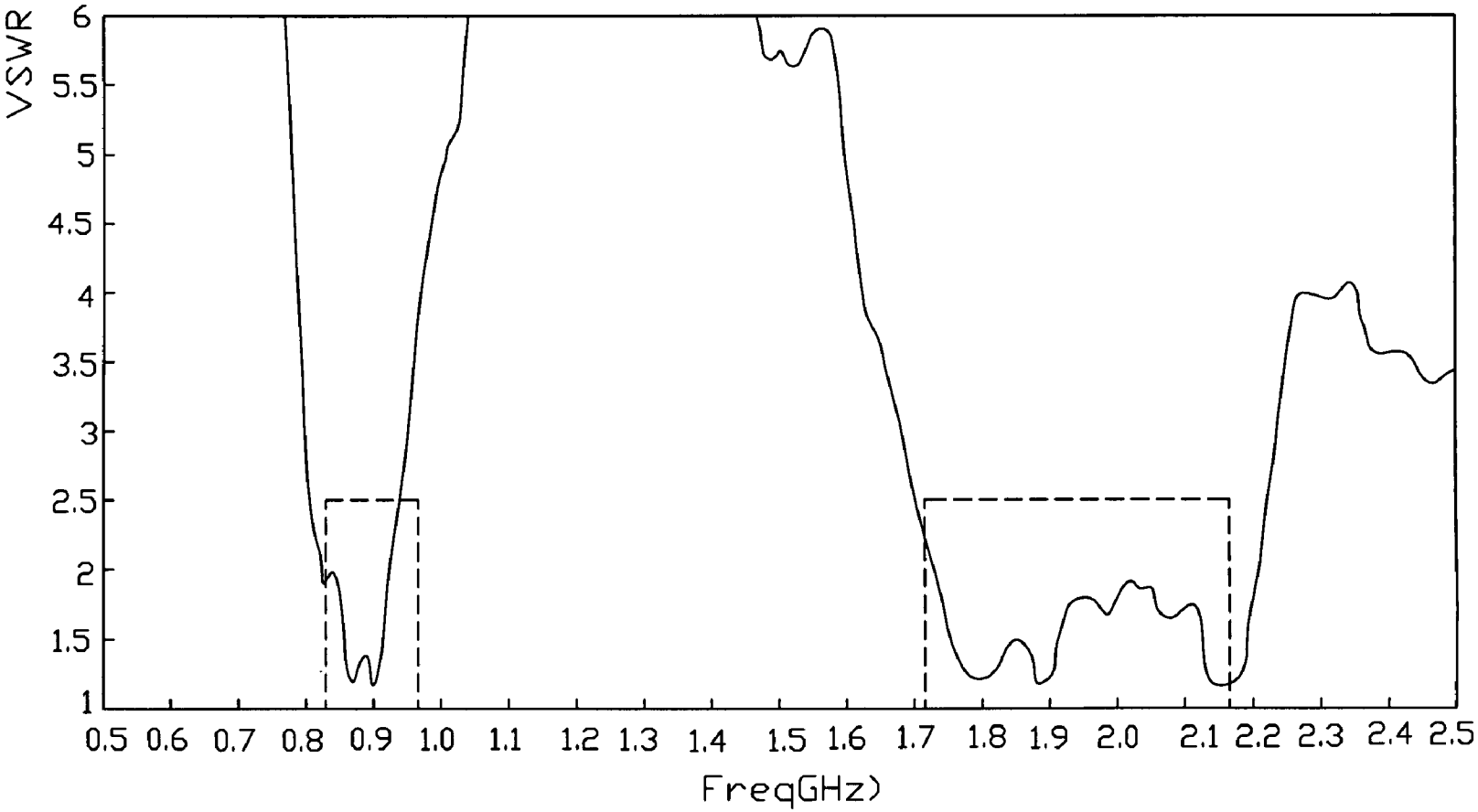
FIG. 4 is a test chart record of the second antenna of the multi-band antenna made in accordance) with present invention, showing VSWR as a function of WWAN frequencies.

Referring to FIG. 3, the first antenna 1 can cover the frequencies on 2.4 GHz-2.7 GHz and 5.15 GHz-5.85 GHz which fit in with the frequencies with WiMAX, WiFi and Bluetooth. Referring to FIG. 4, the second antenna 2 can cover the frequencies bands on 824 MHz-960 MHz and 1.71 GHz-2.17 GHz under GSM, CDMA200, WCDMA and TD-SCDMA.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a grounding element extending along a lengthwise direction and comprising a first and second lengthwise sides;

a first antenna, connected to the grounding element and comprising a first connecting element extending from the grounding element and a first radiating element electrically connected to the first connecting element;

a second antenna, connected to the grounding element and comprising a second connecting element extending from the grounding element and a second radiating element electrically connected to the second connecting element;

a coupling radiating arm, extending from the grounding element;

said first radiating element comprising a first radiating portion extending from the first connecting element in both a longitudinal direction and a transversal direction and a second radiating portion substantially leptosomatic, said second radiating element substantially extending in a lengthwise direction and forming a first radiating section operating on a first frequency bands and a second radiating section operating on a second frequency bands, said first antenna located between the first radiating section of the second radiating element and the grounding element in a vertical direction, the coupling radiating arm located between the first radiating section of the second radiating element of the second antenna and the grounding element in the vertical direction, wherein the second connecting element of the second antenna comprises a first connecting portion extending from the second end and the second side of the grounding element along a gradient direction and forming a slot between the first connecting portion and the grounding element, and a second connecting portion upward extending from the first connecting portion and forming an end connected to the second radiating element, the first connecting portion is a trapezoidal shape which has a horizontal edge and is configured by a trapezoid and a triangle, and the second connecting portion extends from the horizontal edge of the first connecting portion.

2. The multi-band antenna as claimed in claim 1, wherein said first antenna extending from the first side of the grounding element and the second antenna extending from the second side of the grounding element.

3. The multi-band antenna as claimed in claim 2, further comprising a pair of setting portions respectively extending from the two ends of the grounding element.

4. The multi-band antenna as claimed in claim 1, wherein said first connecting element of the first antenna is substantially of L shape and comprises a first connecting arm connected to the grounding element and a second connecting arm connected to the first radiating element on a point.

5. The multi-band antenna as claimed in claim 4, wherein said first connecting arm extends from the first side of the grounding element along a horizontal direction to form a slot between the first connecting arm and the grounding element for the grounding element having a cutout.

6. The multi-band antenna as claimed in claim 4, further comprises a feeding line having a first inner conductor connected to the point on the joint of the first radiating element and the second connecting arm and a first outer conductor connected to the grounding element.

7. The multi-band antenna as claimed in claim 1, wherein said grounding element has a second cutout under the first connecting portion to make the slot between the grounding element and the first connecting portion wider.

8. The multi-band antenna as claimed in claim 1, wherein said second radiating element has a main portion perpendicular to the grounding element and two ends thereof respectively downwardly extending from the main portion.

9. The multi-band antenna as claimed in claim 1, wherein said first antenna work for wireless local area network and wireless metropolitan area network and said second antenna work for wireless wide area network.

10. A multi-band antenna, comprising:

a grounding element, extending along a lengthwise direction and comprising a first and second lengthwise sides;

a first antenna, comprising a first connecting element extending from the first side of the grounding element and a first radiating element having a first radiating portion extending from the first connecting element in both a vertical direction and a horizontal direction;

a second antenna, comprising a second connecting element extending from the second side of the grounding element and a second radiating element electrically connected to the second connecting element and substantially extending along a lengthwise direction;

said first antenna located between the second radiating element and the grounding element in a vertical direction, said first connecting element comprising a first connecting arm extending from the grounding element in a horizontal direction to form a slot between the first connecting arm and the grounding element, wherein said second connecting element of the second antenna comprises a first connecting portion extending from the second end and the second side of the grounding element along a gradient direction and forming a slot between the first connecting portion and the grounding element, and a second connecting portion upward extending from the first connecting portion and forming an end connected to the second radiating element, said first connecting portion is a trapezoid shape which has a horizontal edge and can be looked as being formed by a trapezoid and a triangle, and the second connecting portion extends from the horizontal edge of the first connecting portion.

11. The multi-band antenna as claimed in claim 10, wherein said first connecting element further comprises a second connecting arm upward extending from the first connecting arm and the grounding element comprising a first cutout under the first connecting arm.

12. The multi-band antenna as claimed in claim 10, further comprises a coupling radiating arm extending from the second side of the grounding element on the location adjacent to the second connecting element of the second antenna and substantially being of L shape.

13. The multi-band antenna as claimed in claim 10, wherein said grounding element has a cutout under the first connecting portion to make the slot between the grounding element and the first connecting portion wider.

14. A multi-band antenna comprising:

an elongated grounding element extending in a first horizontal plane along a longitudinal direction;

a first antenna extending upwardly from one side edge of the grounding element, and including an L-shaped first connecting element extending in a first vertical plane from the grounding element, and a first radiating element extending from the first connecting element somewhat compliant with said first vertical plane;

a second antenna extending upwardly from the other side edge of the grounding element, and including a second connecting element which extends in a second vertical plane from the grounding element and includes an oblique section extending from the grounding element and a vertical direction upwardly extending from the oblique section, said second antenna further including a second radiating element extending from the second connecting element and lying essentially in a second horizontal plane above the first horizontal plane to define therebetween a space in which said first antenna is located, wherein a coupling arm extends from the other side edge of the grounding element and defining an essentially L-shaped configuration having a first side arm extending close to the second vertical plane, and a second side arm extending close to the second horizontal plane.

15. The multi-band antenna as claimed in claim 14, wherein said second radiating element defines a cutout essentially in alignment with the second side arm in a vertical direction perpendicular to said second horizontal plane.

16. The multi-band antenna as claimed in claim 14, wherein the L-shaped first connecting element includes a first horizontal connecting arm extending from the grounding element, and a first vertical connecting arm extending between the first horizontal connecting arm and the first radiating element under condition that the grounding element defines a cutout in said side edge to form a slot between the first connecting element and the grounding element.

17. The multi-band antenna as claimed in claim 14, wherein said second radiating element defines a length similar to that of the grounding element along the longitudinal direction.

18. The multi-band antenna as claimed in claim 14, wherein said second connecting element includes a connecting portion extending in an oblique direction, and the grounding element defines a cutout in the other side edge to form a slot between the second connecting element and the grounding element.

19. The multi-band antenna as claimed in claim 14, wherein the first side arm lies in a vertical plane while the second side arm lies in a horizontal plane.

20. The multi-band antenna as claimed in claim 14, wherein the second radiating element defines a pair of radiating arms extending downwardly from two opposite ends toward the grounding element.

* * * * *